United States Patent [19]

Stone

[11] 4,283,928

[45] Aug. 18, 1981

[54] TRANSMISSION FOR WASHING MACHINE

[75] Inventor: Aidan M. Stone, Louisville, Ky.

[73] Assignee: General Electric Company, Louisville, Ky.

[21] Appl. No.: 161,103

[22] Filed: Jun. 19, 1980

Related U.S. Application Data

[63] Continuation-in-part of Ser. No. 69,487, Aug. 24, 1979, abandoned.

[51] Int. Cl.[3] ..... D06F 23/04; D06F 37/40

[52] U.S. Cl. ..... 68/23.7

[58] Field of Search ..... 68/23.7; 192/12 B

[56] References Cited

U.S. PATENT DOCUMENTS

| | | | |
|---|---|---|---|
| 2,200,870 | 5/1940 | Armbruster | 68/23.7 X |
| 2,301,046 | 11/1942 | Henderson | 68/23.7 |
| 2,609,697 | 9/1952 | Ruscoe | 68/23.7 X |
| 2,610,498 | 9/1952 | Geldhof et al. | 68/23.7 |
| 2,751,773 | 6/1956 | Woodson | 68/23.7 |
| 2,836,993 | 6/1958 | Johnson et al. | 68/23.7 X |
| 2,844,225 | 7/1958 | Hubbard et al. | 68/23.7 X |
| 2,946,409 | 7/1960 | Jennings | 68/23.7 X |
| 2,964,974 | 12/1960 | Loutrel | 68/23.7 X |
| 3,264,847 | 8/1966 | Johnson et al. | 68/23.7 |
| 3,267,703 | 8/1966 | Conrath et al. | 68/23.7 |
| 3,838,755 | 10/1974 | Cochran et al. | 68/23.6 X |
| 4,165,624 | 8/1979 | Ruble | 68/23.7 |

*Primary Examiner*—Philip R. Coe

*Attorney, Agent, or Firm*—H. Neil Houser; Radford M. Reams

[57] ABSTRACT

A washing machine transmission is disclosed for alternately producing either oscillating agitator drive or basket spin upon rotation of the drive motor in reverse directions. The transmission includes an input shaft rotated by the drive motor and extending parallel to a concentric spin tube and agitator drive shaft. An agitator drive element is oscillated by an oscillation mechanism and in a first direction of rotation of the input shaft is connected to an agitator drive shaft to oscillate the agitator, while in the reverse direction a spin input gear is clutched to the input shaft and drives a spin gear drivingly connected to the spin tube for rotating the basket. A spring-applied friction brake acts on the spin gear to brake the spin tube, but is released upon rotation of the spin tube for spinning the basket by mating cam surfaces acting between the spin gear and the tube to axially retract the spin gear and release the brake. A spin neutral is achieved by a solenoid-operated shifter delaying clutching action between the spin input gear and the input shaft, allowing pump-down of the water prior to initiation of the basket spin.

18 Claims, 4 Drawing Figures

TRANSMISSION FOR WASHING MACHINE

CROSS REFERENCE TO RELATED APPLICATION

This is a continuation-in-part of copending application Ser. No. 069,487, filed Aug. 24, 1979, and now abandoned, and assigned to the assignee of the present application.

BACKGROUND DISCUSSION

In conventional washing machines, the washing action is achieved by oscillation of an agitator disposed within a washing machine basket which contains the clothing items to be washed and fluid for washing the clothes. After each wash and rinse agitation step in the cycle, the liquid is extracted by a high speed rotation of the basket. Current washing machine designs thus require a transmission mechanism for establishing alternate drive to the washing machine agitator or the clothes receiving basket.

U.S. Pat. Nos. 2,751,773; 2,844,225 and 2,946,409 each disclose washing machine transmissions which offer the advantage of a simple actuation of the transmission by reversal of the drive motor, such that in a first direction of rotation of the drive motor an oscillation mechanism is actuated which is coupled to an agitator drive shaft. The oscillation mechanism is carried on a gear frame secured to a spin tube connected to the washing machine basket. The gear frame is braked to the stationary housing during the drive of the oscillation mechanism to produce the agitator oscillation.

Upon reversal of the direction of the input from the motor, the gear frame is clutched to the input drive of the transmission, the brake is released, and the entire assembly rotates to produce basket spin.

While offering the advantage of a relatively simple transmission structure, with no controls required since the simple reversal of the drive motor carries out the change in drive mode between agitation and spin, the arrangement requires a relatively massive gear frame together with all of the components of the oscillation mechanism to rotate at relatively high speed during the basket spin drive mode.

This has the disadvantage of requiring relatively large clearance spaces between the transmission housing and the gear frame, increasing the volume occupied by the transmission housing and also requiring a relatively large volume of transmission lubricant to occupy the interior space.

Also, the relatively large mass of the gear frame rotated at high speed increases the potential unbalanced forces generated during spin.

Other transmission designs, while not requiring rotation of a gear frame and oscillation mechanism, have generally been of relatively complex configuration or require shift controls.

In current washing machine designs, there is often provided a drain-down interval in which the water within the basket, and the tub in which the basket is mounted, is pumped down prior to the initiation of the basket spin. Since only a single drive motor is provided to drive the drain pump and the transmission, delay means are provided for delaying the initiation of the basket spin or rotation some predetermined interval after the drive motor is energized for rotation in the direction resulting in basket spin. The pump is operated, in response to rotation of the motor in this direction, to drain liquid from the basket and tub. Thus a substantial part of the liquid is drained before basket rotation begins.

Such delay means can be provided by an electrical control over a clutch interposed between the electric motor and the transmission or by a mechanical delay which may be built into the clutching unit by way of example.

It would be advantageous to provide the delay by the washing machine transmission itself. That is to provide a neutral in the washing machine transmission, such as to conveniently allow the introduction of a delay period after the initiation of motor operation for spin drive.

Accordingly, it is an object of the present invention to provide a transmission for producing an oscillatory and rotative drive for connection to the washing machine agitator and basket, respectively, which causes an alternate drive upon reversing direction of input drive from the drive motor in which large mass rotating components are not required and which may be contained within a relatively compact housing structure.

It is a further object of the present invention to provide such a transmission which does not involve a complex configuration or the necessity for separate actuation controls, in which the drive therethrough automatically shifts from the oscillating agitator drive mode to the basket spin mode upon a simple reversal in direction of the rotary input drive.

It is still a further object of the present invention to provide such a washing machine transmission which is provided with a neutral condition in the spin drive mode to enable the incorporation of a time delay in the initiation of the basket spin drive after the input drive is established in the direction tending to produce basket spin rotation.

It is yet another object of the present invention to provide such a washing machine transmission which is relatively simple in configuration, incorporating components which are reliable in operation and rugged in construction to enable the transmission to be manufactured at relatively low cost while being reliable in operation.

SUMMARY OF THE INVENTION

These and other objects of the present invention, which will become apparent upon a reading of the following specification and claims, are achieved by a transmission comprising a transmission housing with a spin tube rotatably mounted therein and extending therefrom for connection to a clothes basket or receptacle and an agitator drive shaft rotatably mounted therein and extending therefrom through the spin tube for connection to an agitator. An input shaft is rotatably mounted in the housing in spaced relationship to the spin tube and drive shaft and extends from the housing for rotation selectively in either of a first and a second direction.

An oscillation mechanism is operatively connected to the input shaft and includes an agitator drive element which oscillates in response to rotation of the input shaft. Means is provided for connecting the agitator drive element to the agitator drive shaft when the input shaft rotates in a first direction and for disconnecting the agitator drive element from the agitator drive shaft when the input shaft rotates in the other direction, so that the agitator is oscillated when the input shaft rotates in the first direction.

A spin drive means drivingly connects the input shaft with the spin tube and includes clutch means operatively connected to the input shaft and normally effective to slip when the input shaft rotates in the first direction and to complete the driving connection from the input shaft to the spin drive means when the input shaft rotates in the second direction.

A neutral shifter arrangement is incorporated, including a solenoid-operated shifter arm which causes the clutch means of the spin drive to slip even though the input shaft is rotating in the second direction to provide a controlled delay before initiation of the basket spin after the input shaft begins to rotate in the second direction.

In the illustrated embodiment the agitator drive member is a pinion gear which is mounted about and is slidable along the agitator drive shaft. The clutching of the agitator pinion gear to the agitator drive shaft in the first direction of rotation of the input shaft is achieved by movement of a sleeve nut, threaded onto a threaded sleeve which is pinned to the input shaft. The direction of the mating threads is such as to cause a movement of the agitator pinion gear into engagement with an agitator shaft mounted clutching pin to produce the clutching action when the input shaft rotates in the first direction. In the reverse or other direction of rotation of the input shaft, the threaded engagement causes motion of the sleeve nut tending to produce disengagement of the agitator pinion gear from the agitator drive shaft clutching pin.

The spin drive means clutch means includes a clutch hub pinned to the input shaft and aligned with a hub portion formed on the spin input gear, with an LGS clutch spring wrapped around the outside diameter of the clutch hub and the hub formed on the gear. The direction of wind of the LGS clutch is such as to slip when the clutch hub rotates in a first direction with the input shaft and to drivingly connect the clutch hub to the spin input gear hub portion when the clutch hub rotates in the second direction.

An LGS sleeve surrounds the LGS spring clutch and includes a notch which receives a tab on the LGS clutch. An idler neutral shifter rod, when actuated, engages the sleeve to prevent the sleeve, and thus the tab, from rotating. This causes the LGS clutch to slip, even though the input shaft is rotating in the second direction, to provide a selected period of liquid draining before the receptacle is rotated.

The spring-applied brake comprises a series of brake discs splined to the exterior of the spin gear with interposed friction discs splined to the interior of an annular projection formed in the transmission housing, in a surrounding, partially enclosing relationship with the spin gear. A compression spring encircles the spin tube in compressive engagement with the spin gear, while the spin gear has a flange portion compressing the brake discs together against a brake disc retainer, to activate the brake and impose braking force on the basket spin tube and basket in the absence of drive through the spin gear. A camming ramp arrangement acts to counteract the force of the compression spring upon rotation of the spin gear in the second direction. This releases the brake so the spin tube and basket can be rotated for centrifugal extraction.

DETAILED DESCRIPTION

In the following detailed description, certain specific terminology will be employed for the sake of clarity and a particular embodiment is described in accordance with the requirements of 35 USC 112, but it is to be understood that the same is not intended to be limiting and should not be so construed inasmuch as the invention is capable of taking many forms and variations within the scope of the appended claims.

Figure 1:
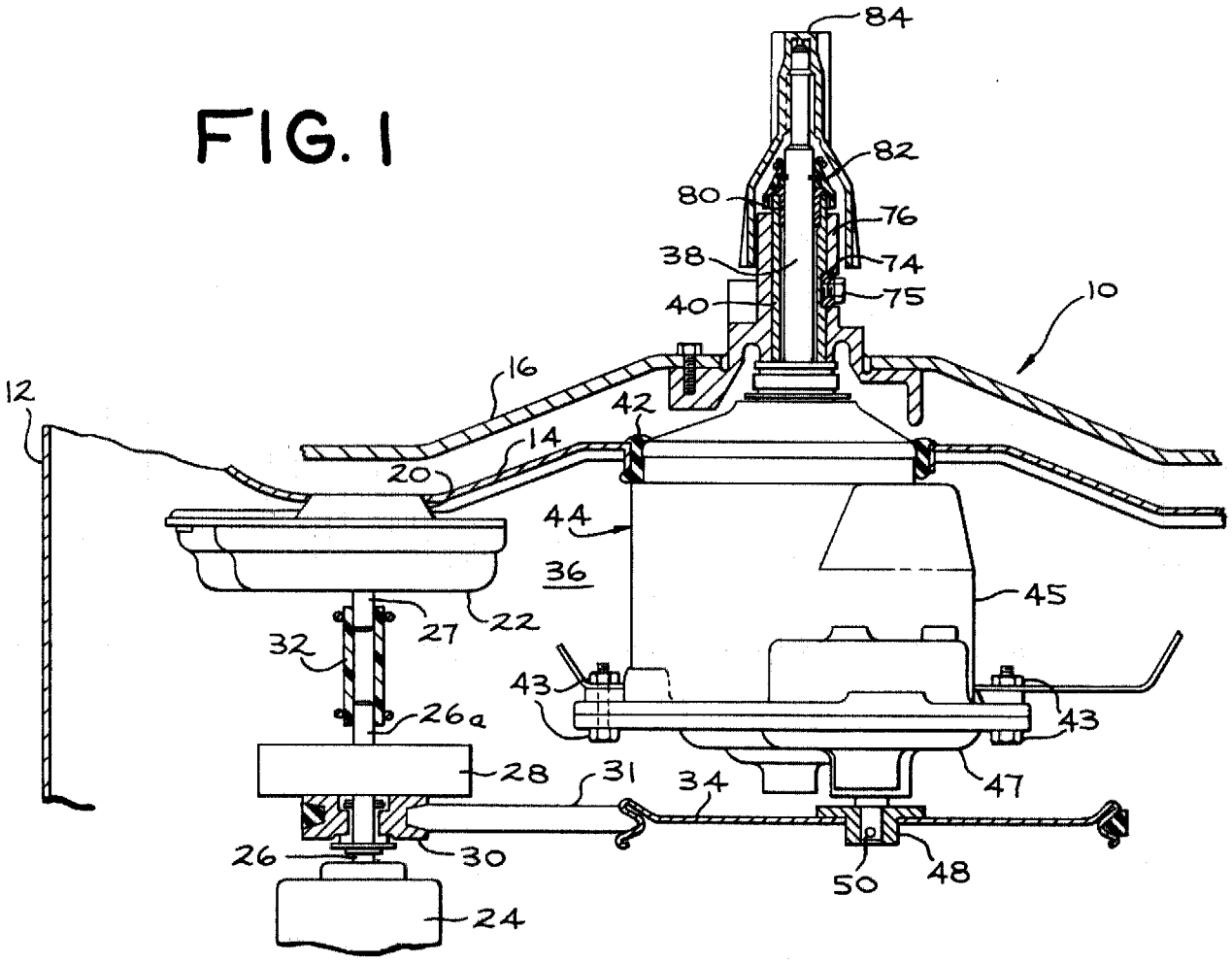
FIG. 1 is a fragmentary side elevational view of a washing machine incorporating a transmission according to the present invention with portions of a number of components, such as the exterior cabinetry broken away to reveal the general arrangement of the washing machine drive components including the transmission.

Referring to the drawings, FIG. 1 depicts a washing machine 10 which includes a cabinet 12 which houses in its upper region an outer tub 14, with an inner, perforated clothes receiving basket or receptacle 16. Mounted centrally within the basket 16 is an agitator 18 (see FIG. 2).

Clothes disposed in the basket are subjected to washing action by the oscillation of the agitator 18 during the wash cycle after introduction of the wash water into the outer tub 14 in conventional fashion. After each wash and rinse agitation step, the basket 16 is rotated at high speed in order to extract the wash water from the clothing items, the water drained into a sump 20 and pumped out to a drain by a pump assembly 22.

The agitator 18, basket 16 and pump assembly 22 are all driven by a single reversible electrical drive motor 24 mounted in the lower region of the cabinet 12. The drive motor 24 has an output shaft 26 driving a slip clutch 28, which may be centrifugally actuated in a well-known manner. At the same time, a direct drive is established to the pump 22 by a flexible coupling 32 connecting a motor output shaft extension **26*a* directly to input shaft 27 of the pump 22**.

The output pulley 30 of clutch 28 is drivingly connected to the input pulley 34 of the transmission 36 through a drive belt 31. When motor output shaft 26 and transmission pulley 34 rotate in a first direction, the transmission 36 acts to oscillate the agitator drive shaft 38 coupled to the agitator 18 so as to oscillate the agitator 18. With reverse direction of rotation of the drive motor output shaft 26 and the input pulley 34, the transmission 36 establishes a rotary drive to the spin tube 40 coupled to the basket 16 while discontinuing drive to the agitator drive shaft 38.

The transmission 36 includes a transmission housing 44 comprised of upper housing section 45 and lower housing section 47 secured together by nut and bolt pairs 43. The transmission housing 44 is mounted to the bottom of tub 14 through a central opening, with the gasket 42 sealing off the area between the upper housing section 45 and the bottom of tub 14. Thus, the agitator 18 and the basket 16 are mounted within the tub 14 by means of the agitator drive shaft 38 and the spin tube 40, respectively.

Figure 2:
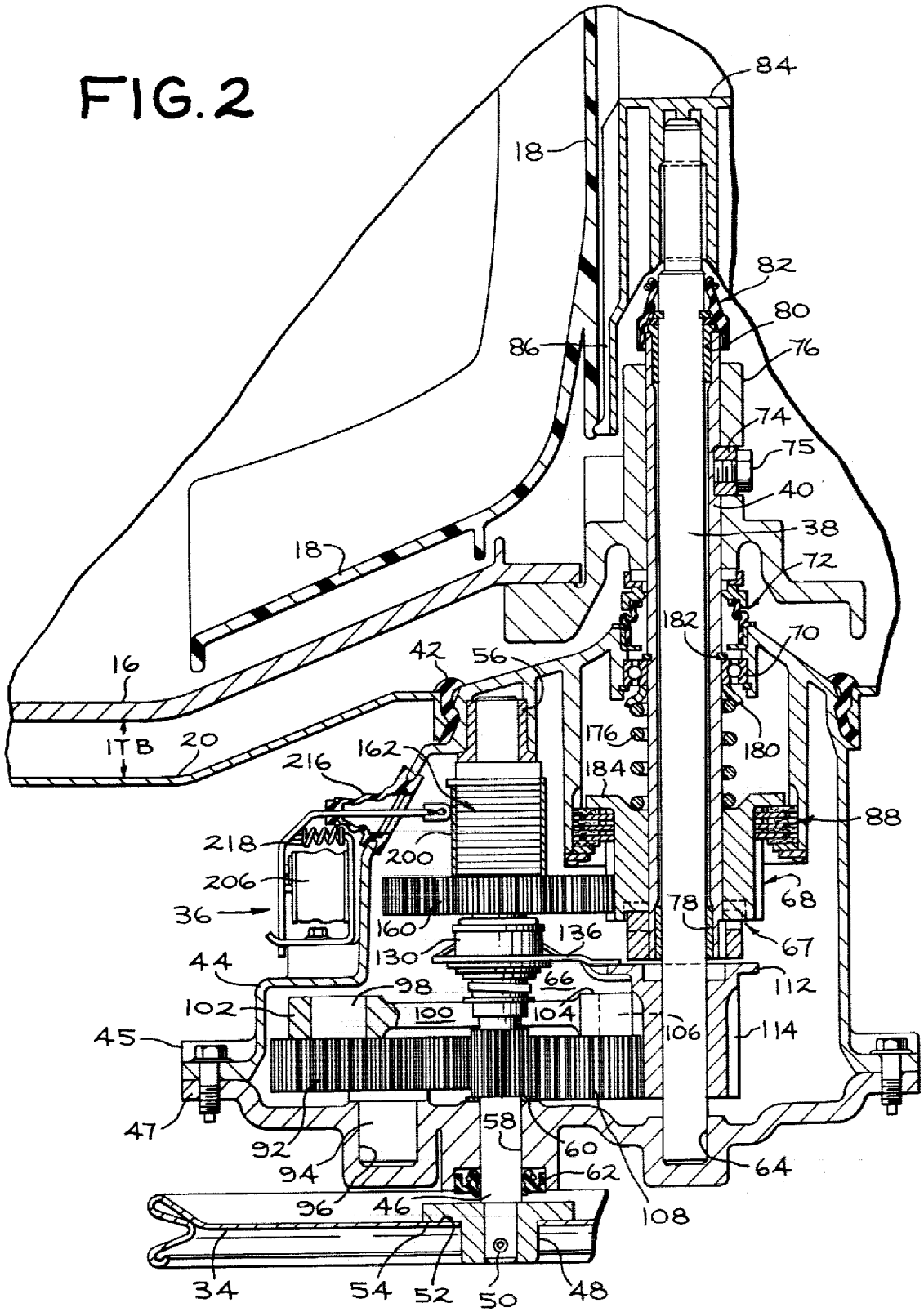
FIG. 2 is a partial view in section of the transmission and associated components of the washing machine shown in FIG. 1.

Referring to FIG. 2, the input pulley 34 is rotatably fixed to an input shaft 46 by means of a hub 48 and a drive pin 50. The input pulley 34 is welded at circumferential points, such as 52, to the front face 54 of the hub 48.

The input shaft 46 extends into the interior of the transmission housing 44 and is mounted for rotation therein in the bearing insert 56, plain bearing 58 and thrust bearing 60. A seal 62 is provided at the point where input shaft 46 passes out of the transmission housing 44.

The spin tube 40 and the agitator drive shaft 38 are mounted concentrically to each other, and extend into the interior of the transmission housing 44 in spaced apart parallel relationship with the input shaft 46. The spin tube 40 terminates at a point intermediate the full depth of the transmission housing 44, while the agitator drive shaft 38 extends through the full length of tube 40. The lower portion of shaft 38 protrudes from tube 40 and is received in socket bore 64.

The agitator drive shaft 38 thus may be driven by oscillation mechanism means generally indicated at 66 (shown in more detail in FIG. 4), acting between the lower region of the input shaft 46 (FIG. 3) and the lower end of the agitator drive shaft 38. Similarly, the upper end of the input shaft 46 is in juxtaposition with the spin tube 40 in the upper region of the transmission housing 44 and tube 40 is drivingly connected to shaft 46 by means of a basket spin drive mechanism generally indicated at 68.

Upon rotation of the input shaft 46 in a first direction a driving connection is established between the oscillation mechanism 66 and agitator drive shaft 38 for oscillating agitator 18. When the input shaft 46 rotates in a second direction the spin drive mechanism drivingly connects the spin tube 40 to the input shaft for rotating or spinning the receptacle 16.

The spin tube 40 is rotatably mounted in the upper section 45 of transmission housing 44 by ball bearing 70. A gasket seal assembly 72 is provided which provides sealing of the spin tube 40 in the transmission housing 44. The upper end of the spin tube 40 is secured by means of a clamping bar 74 and bolts 75 to a basket hub 76. The basket hub 76 in turn is secured and fixed to the basket 16 itself such as to be rotated therewith.

The agitator drive shaft 38 is rotatably supported in a socket bore 64 at the lower end thereof, as well as by sleeve bearings 78 and 80 on the spin tube 40. The agitator drive shaft 38 is sealed to the upper end of spin tube 40 by seal retainer assembly 82. The protruding upper end of the agitator drive shaft 38 is splined to be rotatably secured to the agitator coupling 84, in turn having splines 86 establishing a rotative connection with the agitator 18. Thus, the agitator drive shaft 38 is rotatably connected to the agitator 18 and the spin tube 40 is joined to the basket 16.

The spin tube 40 normally is braked by a spring-applied disc brake generally indicated at 88. Whenever the basket is to be rotated for centrifugal extraction of liquid from the clothes a cam arrangement generally indicated at 67, operated by basket spin drive mechanism 68, acts to release the brake as will be described in detail hereinafter.

Figure 3:
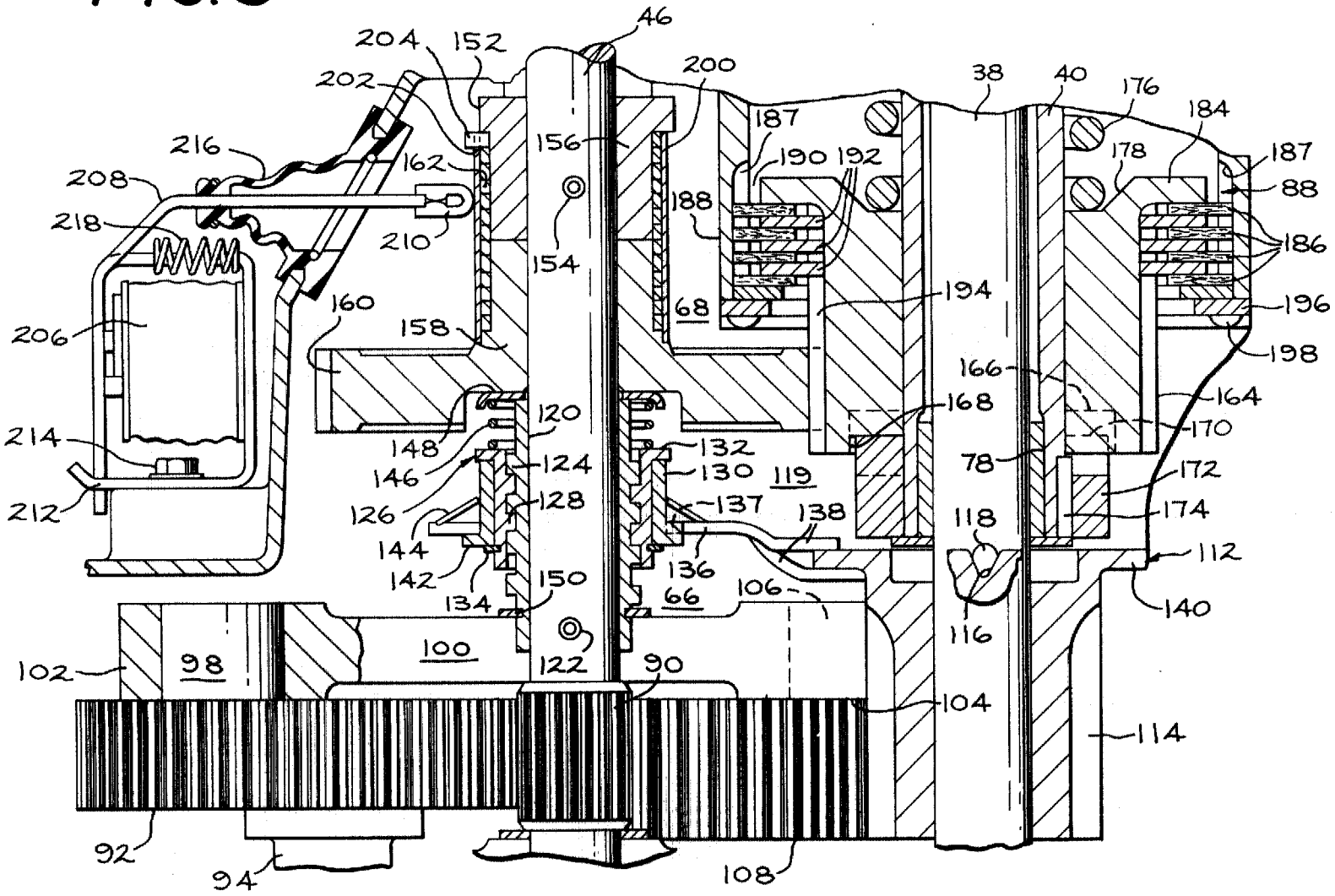
FIG. 3 is an enlarged fragmentary view in partial section of the transmission shown in FIGS. 1 and 2.

Referring to FIG. 3, the oscillation mechanism 66 includes a pinion gear 90 machined into the portion of the input shaft 46 adjacent the lower section 47 of the transmission housing 44. The pinion gear 90 is in mesh with a crank gear 92 so as to rotate gear 92 when the input shaft 46 rotates (FIG. 4).

The crank gear 92 is rotatably mounted within the transmission housing 44 by a stub shaft 94 received in a bore 96 in the lower housing section 47 (see FIG. 2). The crank gear 92 is formed with a crank pin 98 offset from the center of rotation of the crank gear 92. The pin 98 pivotally mounts one end of the crank link 100 formed with eyelet 102 slidably fit over the crank pin 98.

Figure 4:
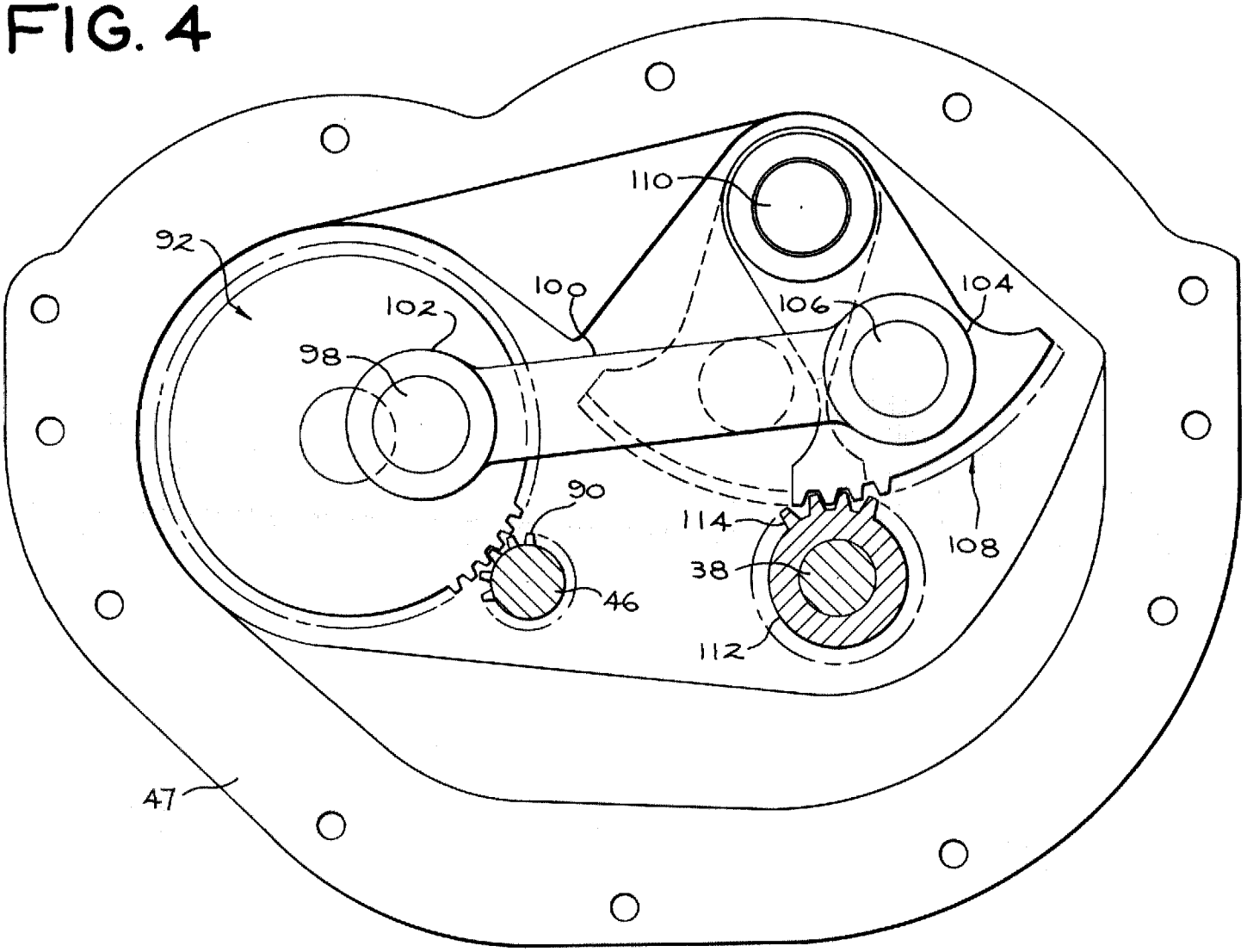
FIG. 4 is a plan view of the oscillation mechanism gear layout used in the illustrative transmission.

Referring to FIG. 4, an eyelet 104 is formed at the other end of the crank link 100 and received over a crank pin 106 pivotally mounted to a sector gear 108. The sector gear 108 in turn is mounted for pivotal oscillating movement in the transmission housing 44 on a pivot pin 110 mounted in the lower housing section 47.

Sector gear 108 is in meshing relationship with an agitator drive element comprised of an agitator pinion gear 112 which is slidably mounted on the agitator drive shaft 38, and formed with gear teeth 114 of sufficient length so as to remain in mesh with the sector gear 108 during a limited degree of sliding travel of the drive element 112 on the agitator drive shaft 38.

In upmost position of pinion gear 112, shown in FIG. 3, the agitator pinion gear 112 is clutched to the agitator drive shaft 38 by a recess 116 moving over a tapered drive pin 118 such as to establish a rotary connection therebetween in this position. Rotation of input shaft 46 rotates the crank gear 92 and the resultant eccentric rotational or reciprocal movement of the crank link 100 impresses an oscillatory motion on the sector gear 108. This movement in turn is transmitted to the agitator pinion gear 112. The oscillation of the pinion gear 112 is transmitted to the agitator drive shaft 38 only when the agitator drive shaft 38 is clutched to the agitator pinion gear 112 by engagement of pin 118 in recess 116. Oscillation of the agitator drive shaft 38 produces the oscillation of the agitator 18 itself.

The clutching action or engagement on pin 118 and recess 116, is carried out by agitation drive control means generally indicated at 119. The agitation drive control means is effective to move pinion gear 112 upwardly along shaft 38 when input shaft 46 rotates in the first or agitation direction and to move pinion gear 112 downwardly along shaft 38 when input shaft 46 rotates in the second or spin direction.

The agitation drive control means 119 includes a threaded sleeve 120 affixed to the input shaft 46 by means of a roll pin 122. Threaded sleeve 120 has an exterior thread 124 formed on its outside diameter.

A nut sleeve 126 formed with an internal thread 128 is threadably engaged therewith. Mounted on the outside diameter of the nut sleeve 126 is a yoke sleeve 130 axially fixed with respect to the nut sleeve 126 between a flange 132 and a snap retainer 134. The yoke sleeve 130 carries a yoke 136 which has a forked end 138 capturing a flange 140 formed integrally with the agitator pinion gear 112 such that axial movement of the yoke 136 results in corresponding axial movement of the agitator pinion gear 112.

The yoke 136 is passed over the exterior of the yoke sleeve 130 and urged into engagement with a yoke sleeve flange 142 by means of a Belleville spring or push-on retaining clip 144.

The nut sleeve 126 is preloaded by compression spring 146 and a cup washer 148. The yoke 136 is keyed to the yoke sleeve 130 by key section 137 to restrain rotation of yoke sleeve 130 so that relative axial movement takes place between the threaded sleeve 120 and the nut sleeve 126 between the full-up and the full-down positions of the nut sleeve 126 and the yoke 136, as well as the agitator pinion gear 112 upon rotation of the input shaft 46 in either direction. Friction between yoke sleeve 130 and nut sleeve 126 causes nut sleeve 126 to move axially of threaded sleeve 120 as sleeve 120 rotates with shaft 46. When sleeve 126 engages snap retainer 150 at the lower end of its travel of control means 119 or when pin 118 engages in recess 116 at the upper end of travel of control means 119, yoke sleeve 130 slips relative to nut sleeve 126 and the mechanism does not bind.

In the full-up position, the tapered drive pin 118 seats in the recess 116 to form an abutment and establishing drive of the agitator pinion gear 112 into the agitator drive shaft 38.

In the full-down position, the nut sleeve 126 abuts a washer 150 at which position the tapered drive pin 118 is moved entirely out of engagement with the recess 116, discontinuing driving relationship between the agitator drive shaft 38 and the agitator pinion gear 112 to thus cease oscillation of the agitator drive shaft 38.

The agitator pinion gear 112 of course continues to be oscillated by the oscillation mechanism means 66. Thus, the oscillation mechanism means 66 continues to be operated but is declutched by operation of the declutching means comprised of the exterior thread 124 of threaded sleeve 120, nut sleeve 126, and the interengagement of the yoke 136 and the agitator pinion gear 112.

The basket spin drive mechanism 68 conversely is activated upon the rotation of the input shaft 46 in the direction corresponding to that producing declutching between the agitator pinion gear 112 and the agitator drive shaft 38. The basket spin drive mechanism 68 establishes rotary drive to the spin tube 40 in this latter direction of rotation of the input shaft 46.

One-way clutching means is provided between the spin input gear 160 and the input shaft 46. This includes a clutch hub 152 pinned to the input shaft 46 by roll pin 154 so as to rotate together therewith. The clutch hub 152 includes an axially extending hub portion 156 which is in alignment with a hub portion 158 integral with a spin input gear 160. The hub portions 156 and 158 have the same diameter.

Encircling both the hub portion 156 of the clutch hub 152 and the hub portion 158 of gear 160 is an LGS clutch spring 162 which has a direction of wind such that a rotary driving connection is established between the clutch hub 152 and the spin input gear 160, causing the same to rotate together, upon rotation of the input shaft in the spin direction. Whereas, in the opposite or agitate direction of rotation of the input shaft 46, in which there is a driving connection between the agitator drive shaft 38 and the agitator pinion gear 112, the LGS clutch spring slips and the driving connection from hub portion 156 to hub portion 158 is disestablished.

The spin input gear 160 is mounted for free rotation on the input shaft 46 such that rotation of gear 160 in response to rotation of the input shaft 46 results only from the action of a one-way clutching means in the form of LGS spring clutch 162.

The spin input gear 160 is in meshing relationship with a spin gear 164 which is slidably mounted on the spin tube 40. A rotary driving connection between the spin tube 40 and the spin input gear 164 is established by ramp cam surfaces 166 formed on a recess 168 extending into the lower end of the spin gear 164 and corresponding ramp cam surfaces 170 formed in a spin cam 172 secured to the spin tube 40 by means of a key 174.

A brake actuating spring 176 is seated in a recess 178 formed in the upper axial face of spin gear 164. The upper end of spring 176 is seated against a retainer 180 abutting the ball bearing 70. The ball bearing in turn is located axially by a snap ring retainer 182 to provide a fixed reaction point for the brake actuating spring 176. The brake actuating spring 176 acts to normally cause actuation of the spring-applied disc brake 88 by axially downward movement of the spin gear 164. A brake flange 184 extends outwardly at the upper end of spin gear 164 and acts, in response to downward force from spring 176, to compress a plurality of interleaved friction discs 186 and 192.

A tubular protrusion 188 formed in the upper housing section 45 has an internal bore 190 concentric with and partially surrounding the spin gear 164. Friction discs 186 mate with internal splines 187 formed on the bore 190, which prevents the discs 186 from rotating. Friction discs 192 are splined and mate with the external teeth 194 of the spin gear 164 such as to be rotatably connected thereto.

A brake retainer plate 196 is secured by screws 198 to protrusion 188. Thus the interleaved discs 186 and 192 are positioned between flange 184 and plate 196. During agitation downward pressure from spring 176 acts through flange 184 and a compressive force is exerted on discs 186 and 192. The friction between the discs prevents discs 192 from rotating which, in turn, prevents gear 164 and spin tube 40 from rotating. The result is that the basket 16 is substantially stationary during agitation.

The ramp cam surfaces 166 and 170 are inclined in the second direction, i.e., the direction of rotation of spin gear 164 for rotation of basket 16 for centrifugal extraction of liquid from the fabrics. Whenever drive is established by the spin gear 164 in the second direction, the ramp cam surfaces 166 and 170 raise spin gear 164. This counteracts the disc brake actuating spring 176 and causes the spring-applied disc brake 88 to be released to enable free rotation of the spin tube 40 and basket 16. Conversely, whenever drive is disestablished by the cessation of clutching action of the LGS clutch spring 162, spin gear 164 is moved downwardly by spring 176, and the spin tube 40 and basket 16 are automatically braked.

As described above, it is often advantageous to provide a simple means for delaying the action of the spin drive of the basket 16 such that the pump 22 may pump the water from the tub 14 and basket 16 prior to initiation of the basket spin. Since the drive motor 24 drives both the pump and the transmission 36, the delay cannot be by means of a control over the energization of the drive motor 24.

A provision is therefore provided for introducing a spin drive neutral which prevents activation of the spin drive for the basket for a predetermined interval after the reversal of direction of rotation of the drive motor and input shaft 46 at the end of each agitation step.

The spin neutral is created by a control means acting on the LGS clutch spring 162 for precluding the establishment of drive from the clutch hub 152 to the spin input gear 160 for an interval of predetermined duration. This means includes the provision of an LGS spring sleeve 200 which surrounds the LGS clutch spring 162 and is notched to provide a slot indicated at 202, axially extending into the LGS spring sleeve 200 for receiving a protruding terminal end tab 204 of clutch spring 162.

When hub 152 rotates with input shaft 46 in the second or spin direction, friction between axially extending portion 156 and LGS clutch spring 162 tends to cause spring 162 to tighten about portion 156 and hub portion 158 of spin input gear 160. This drivingly connects gear 160 to input shaft 46 for concurrent rotation therewith. However, if tab 204 is restrained from rotating, the clutch will slip and this driving connection will not be established.

Selective restraint of tab 204 is provided by a coil 206 which controls the position of an armature shifter arm 208 having a terminal portion 210 adapted to be drawn into frictional engagement with the LGS spring sleeve 200 upon energization of the coil 206. Frictional engagement can be enhanced by addition of grooves in the outer diameter of sleeve 200. Engagement of sleeve 200 by terminal portion 210 holds the sleeve 200 stationary. The engagement of tab 204 in slot 202 of sleeve 200, in turn, holds tab 204 against rotation and LGS clutch spring 162 slips.

Armature shifter arm 208 is mounted on a bracket arm 212 to the upper housing section 45 by a threaded fastener 214. The armature shifter arm 208 extends through a sealing boot 216 positioned in a corresponding opening formed in the upper housing section 45. A return spring 218 urges the armature shifter arm 208 outwardly and out of engagement with the LGS spring sleeve 200 whenever the armature is not energized.

The coil 206 is adapted to be energized for activating the armature shifter arm 208 for a predetermined interval by control means included in the washing machine control circuitry for a predetermined interval necessary to allow a pump-down of the water contained in the tub 14 and basket 16. Upon deenergization of the coil 206 for armature shifter arm 208, the return spring 218 disengages the armature shifter arm 208 and allows the driving relationship between the clutch hub 152 and the spin input gear 160 to be asserted.

Accordingly, it can be appreciated that the transmission described achieves the objects of the present invention in that it does not include large rotating gear frames, but rather all of the gearing elements are only rotated about their own axes. The arrangement is also quite compact while providing the necessary output drives.

The simple control over the transmission drive mode by a mere reversal of direction of drive from the drive motor 24 is retained, achieving the shift from the drive mode in which the oscillatory output motion of the agitator drive shaft 38 occurs to the mode in which rotative drive of the basket 14 at relatively high speed by virtue of the gear reduction from spin input gear 160 to the spin gear 164.

The basket 14 is reliably maintained in a brake condition except during the spin mode in accordance with the requirements of current washing machine designs.

It should be apparent to those skilled in the art that, while I have described what I presently consider to be the preferred embodiment of my invention in accordance with the Patent Statutes, changes may be made therein without actually departing from the true spirit and scope of the invention.

What I claim as new and desire to secure by Letters Patent is:

1. A washing machine transmission for selectively providing oscillatory drive to an agitator and rotary drive to a clothes receiving receptacle, said transmission comprising:

a transmission housing;

a spin tube rotatably mounted in said housing and extending therefrom for driving connection to a clothes receptacle;

an agitator drive shaft rotatably mounted in said housing and extending therefrom through said spin tube for driving connection to an agitator;

an input shaft rotatably mounted in said housing in spaced relationship to said spin tube and drive shaft, said input shaft extending from said housing for rotation selectively in either of a first and a second direction;

oscillation mechanism operatively connected to said input shaft and including an agitator drive element caused to oscillate in response to rotation of said input shaft;

means for drivingly connecting said agitator drive element to said agitator drive shaft for oscillating said drive shaft when said input shaft rotates in the first direction and for disconnecting said agitator drive element from said agitator drive shaft when said input shaft rotates in the second direction;

spin drive means for drivingly connecting said input shaft with said spin tube, said spin drive means including clutch means operatively connected to said input shaft and normally effective to slip when said input shaft rotated in the first direction and to complete the driving connection from said input shaft to said spin drive means when said input shaft rotates in the second direction.

2. A washing machine transmission according to claim 1 further including: a spin tube brake means normally applying a braking force to said spin tube, said spin drive means being connected to said spin tube brake means and effective to cause said spin tube brake means to release the braking force when said input shaft rotates in the second direction.

3. A washing machine transmission according to claim 2 wherein said spin drive means includes: a spin tube drive gear rotatably mounted about said spin tube, and connected to said spin tube for concurrent rotation; a spin input gear mounted about said input shaft for relative rotation thereto and drivingly connected to said tube drive gear and a hub rotatable with said input shaft; and wherein said clutch is effective to connect said hub to said spin input gear when said input shaft rotates in the second direction.

4. A washing machine transmission according to claim 3 wherein: said spin tube drive gear is axially movable along said spin tube and is effective in a first axial position to cause said spin tube brake means to apply the braking force and is effective upon axial movement from its first axial position to cause said brake means to release the braking force, a cam ring is fixed to said spin tube; said spin tube drive gear and said cam ring have cooperative cam surfaces formed thereon and configured to cause said spin tube drive gear to move from its first axial position when said spin tube drive gear is rotated in response to rotation of said input shaft in the second direction.

5. A washing machine transmission according to claim 4 wherein said spin tube means comprises a fixed annular housing portion having a bore formed therein concentric to and surrounding at least part of said spin tube drive gear and a plurality of interleaved friction discs with axially alternate ones of said friction discs rotatably secured respectively to said spin gear and said annular housing portion bore, said spin tube drive gear is formed with a flange overlying the friction disc at one axial end of said plurality of discs, brake stop retainer means overlying the friction disc at the other axial end of said plurality of discs so that said discs are frictionally engaged by compression between movement of said annular flange and said brake retainer plate when said spin tube drive gear is in its first axial position and wherein said brake means further includes a brake operating spring urging said spin tube drive gear to its first axial position for establishing the braking force to said spin tube.

6. A washing machine transmission according to claim 4 wherein said agitator drive element comprises an agitator pinion gear rotatably mounted about and axially movable along said agitator drive shaft, said pinion gear is effective in a first axial position to cause said agitator shaft to oscillate with said pinion gear and is effective upon axial movement from its first axial position to rotate about said agitator shaft; said transmission further including agitation control means effective to move said pinion gear to its first axial position when said input shaft rotates in the first direction and to move said pinion gear from its first axial position when said input shaft rotates in the second direction.

7. A washing machine transmission according to claim 6 wherein said agitation control means includes a yoke engaging said agitator pinion gear for movement together therewith axially of said agitator shaft, a yoke sleeve concentrically mounted about said input shaft and drivingly connected to said yoke, and cam means connecting said yoke sleeve with said input shaft and effective to move said yoke sleeve axially of said input shaft in a direction to cause said yoke to move said agitator pinion gear to its first axial position when said input shaft rotates in the first direction and to move said yoke sleeve axially of said input shaft in a direction to cause said yoke to move said agitator pinion from its first axial position when said input shaft rotates in the second direction.

8. A washing machine transmission according to claim 7 wherein: said cam means comprises a threaded sleeve affixed to said input shaft for rotation therewith and a nut sleeve threadedly engaging said threaded sleeve, said yoke sleeve is mounted about said nut sleeve to be carried thereby axially of said input shaft, and wherein the threaded engagement produces said movement of said nut sleeve in different axial directions along said input shaft as said input shaft rotates in the first and second directions, respectively.

9. A washing machine transmission according to claim 8 wherein: said agitator pinion has a second axial position remote from its first axial position; said yoke sleeve has a sliding engagement with said nut sleeve; said transmission being constructed and arranged such that rotation of said input shaft in a given direction causes axial movement of said nut sleeve along said threaded sleeve as said agitator pinion gear moves from one to the other of its first and second axial positions and continued rotation of said input shaft in that given direction causes relative rotary movement between said nut sleeve and said yoke sleeve.

10. A washing machine transmission according to claim 3 wherein said hub and said spin input gear respectively include aligned cylindrical surfaces and said clutch includes a wound spring clutch member positioned about said surfaces and wound in a direction to slip relative to at least one of said surfaces when said input shaft rotates in the first direction and to drivingly connect said hub to said spin input gear when said input shaft rotates in the second direction.

11. A washing machine transmission according to claim 10 further includes spin neutral means operable when actuated to prevent said wound clutch from drivingly connecting said hub to said spin input gear even though said input shaft is rotating in the second direction so that rotation of said spin tube is prevented so long as said spin neutral means is activated.

12. A washing machine transmission according to claim 1 wherein said agitator drive element comprises an agitator pinion gear rotatably mounted about and axially movable along said agitator drive shaft, said pinion gear is effective in a first axial position to cause said agitator shaft to oscillate with said pinion gear and is effective upon axial movement from its first axial position to rotate about said agitator shaft; said transmission further including agitation control means effective to move said pinion gear to its first axial position when said input shaft rotates in the first direction and to move said pinion gear from its first axial position when said input shaft rotates in the second direction.

13. A washing machine transmission according to claim 12 wherein said agitation control means includes a yoke engaging said agitator pinion gear for movement together therewith axially of said agitator shaft, a yoke sleeve concentrically mounted about said input shaft and drivingly connected to said yoke, and cam means connecting said yoke sleeve with said input shaft and effective to move sad yoke sleeve axially of said input shaft in a direction to cause said yoke to move said agitator pinion gear to its first axial position when said input shaft rotates in the first direction and to move said yoke sleeve axially of said input shaft in a direction to cause said yoke to move said agitator pinion from its first axial position when said input shaft rotates in the second direction.

14. A washing machine transmission according to claim 13 wherein: said cam means comprises a threaded sleeve affixed to said input shaft for rotation therewith and a nut sleeve threadedly engaging said threaded sleeve, said yoke sleeve is mounted about said nut sleeve to be carried thereby axially of said input shaft, and wherein the threaded engagement produces said movement of said nut sleeve in different axial directions along said input shaft as said input shaft rotates in the first and second directions, respectively.

15. A washing machine transmission according to claim 14 wherein: said agitator pinion has a second axial position remote from its first axial position; said yoke sleeve has a sliding engagement with said nut sleeve; said transmission being constructed and arranged such that rotation of said input shaft in a given direction causes axial movement of said nut sleeve along said threaded sleeve as said agitator pinion gear moves from one to the other of its first and second axial positions and continued rotation of said input shaft in that given direction causes relative rotary movement between said nut sleeve and said yoke sleeve.

16. In a washing machine including a clothes receiving basket and an agitator disposed centrally within the basket, a reversible drive motor for supplying power selectively to oscillate the agitator and to rotate the basket; a transmission including:

a transmission housing;

a spin tube rotatably mounted in said housing and extending therefrom to be coupled to the basket for rotating the basket;

an agitator drive shaft rotatably mounted in said housing and extending therefrom through said spin tube to be coupled to the agitator for oscillating the agitator;

an input shaft rotatably mounted in said housing in spaced apart parallel relationship to said spin tube and said agitator drive shaft and extending from said housing for coupling to the motor selectively to be rotated in either of a first and a second direction;

oscillation mechanism driven by rotation of said input shaft and including an agitator drive element which oscillates in response to rotation of said input shaft;

agitation control means effective to operatively connect said agitator drive element to said agitator drive shaft in response to rotation of said input shaft in the first direction and to operatively disconnect said agitator drive element from said agitator drive shaft in response to rotation of said input shaft in the second direction;

spin drive means coupled to said spin tube for rotating said spin tube, including spin clutch means for operatively connecting said spin drive means to said input shaft, said spin cluth being normally effective to slip when said input shaft rotates in the first direction and to complete a driving connection from said input shaft to said spin drive means when said input shaft rotates in the second direction.

17. A washing machine transmission according to claim 16 wherein: said spin drive means includes a spin tube drive gear rotatably connected to said spin tube for rotating said spin tube, disc brake means is connected between said spin tube drive gear and said transmission housing; and said spin drive means includes means for releasing said brake means in response to rotation of said input shaft in the second direction.

18. In a washing machine as set forth in claim 16 further including pump means connected to the drive motor and responsive to rotation of the drive motor corresponding to rotation of said input shaft in the second direction to evacuate liquid from the washing machine, said transmission further including spin neutral means activated for a predetermined period of time upon initial energization of the drive motor to rotate said input shaft in the second direction; said neutral means being operatively connected to said spin clutch means and effective when activated to cause said spin clutch to slip even though said input shaft is rotating in the second direction so that rotation of the basket is prevented and the pump means is operated to evacuate liquid during such period of time.

* * * * *